US005779440A

United States Patent [19]

Stricker et al.

[11] Patent Number: 5,779,440

[45] Date of Patent: Jul. 14, 1998

[54] FLOW ENERGIZING SYSTEM FOR TURBOMACHINERY

[75] Inventors: John G. Stricker, Berlin; John G. Purnell, Catonsville, both of Md.

[73] Assignee: The United States of America as represented by the Secretary of the Navy, Washington, D.C.

[21] Appl. No.: 779,876

[22] Filed: Jan. 6, 1997

[51] Int. Cl.[6] ..... F04D 17/14

[52] U.S. Cl. ..... 415/143; 415/914

[58] Field of Search ..... 415/143, 183, 415/914

[56] References Cited

U.S. PATENT DOCUMENTS

| | | | |
|---|---|---|---|
| 3,221,661 | 12/1965 | Swearingen | 415/143 |
| 3,435,771 | 4/1969 | Riple | 415/143 |
| 4,642,023 | 2/1987 | Dunn | 415/143 |
| 5,061,151 | 10/1991 | Steiger | 415/143 |

OTHER PUBLICATIONS

Foa, J.V. and C.A. Garris, "Cryptosteady Modes of Direct Fluid–Fluid Energy Exchange," in Machinery of Direct Fluid–Fluid Energy Exchange, J.F. Sladky (Editor), American Society of Mechanical Engineers Book AD–7 (New York 1984) pp. 1–13.

*Primary Examiner*—John T. Kwon

*Attorney, Agent, or Firm*—Gary G. Borda; Howard Kaiser

[57] ABSTRACT

The invention is directed to a flow energizing system for turbomachinery including means for forming a plurality of rotating jet-sheet blades upstream of an impeller and a component for circumferentially varying the blade geometries of the plurality of rotating jet-sheet blades. The a component for forming a plurality of rotating jet-sheet blades includes: impeller shroud 26 having upstream-projecting axial extension 28 attached coaxially with and projecting upstream of shroud 26; recirculation chamber 30 surrounding shroud and axial extension, 26 and 28; recirculation flow inlet 32 formed by a gap between housing 12 and downstream ends, 20*a* and 26*a*, respectively, of impeller 20 and shroud 26, for allowing backflow to pressurize recirculation chamber 30; and a plurality of generally axially-extending jet-sheet slots 34 circumferentially distributed around a periphery of axial extension 28 and passing therethrough. The component for circumferentially varying blade geometries of the plurality of rotating jet-sheet blades includes axially-extending stationary liner 36 disposed concentric with and radially inward of axial extension 28 wherein liner 36 is shaped and configured for selectively covering portions of slots 34.

18 Claims, 3 Drawing Sheets

FLOW ENERGIZING SYSTEM FOR TURBOMACHINERY

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of the Invention

The present invention relates generally to turbomachinery and, more particularly, to a nonintrusive flow energizing device for selectively energizing the nonuniform flow into impellers of turbomachinery such as pumps, compressors, and turbines.

2. Brief Description of Related Art

Several methods of improving stability and reducing required power of turbomachinery operating at off-design points have been described and used with varying degrees of success. Such methods employ upstream injection of swirling flow or insertion of stationary blades upstream of the impeller and are thus intrusive methods. Injection of flow requires an outside flow source and hardware for injecting the flow. Upstream stationary blades cause a lose of flow energy (pressure) across the blade chord. To the knowledge of the inventors, none of these methods have been designed for use at design point operation, where benefits include allowing higher driver rotational speeds and reduced wear of impeller vanes and housings where cavitation problems exist. Moreover, none have addressed the problem of nonuniform inflow into the impeller plane which exists in virtually all pump and compression installations.

Nonuniform inflow is a major source of cavitation and noise at both design and off-design operating conditions. To address the problems of nonuniform inflow, a means of adding energy to the flow in a circumferentially-varying manner is required. Such a scheme would be infeasible using circumferentially-varying blade row geometries, but may be feasible by adding pre-rotation energy to the flow using jet-type momentum exchangers. Thus, there is a need for a nonintrusive flow energizing device for adding energy to nonuniform flows approaching impellers of turbomachinery such that circumferential variations in impeller vane approach flow profiles are reduced, periodic variations of impeller vane incidence angles are reduced, and total energy is increased so that choking, stall, cavitation, and/or surge characteristics are improved.

SUMMARY OF THE INVENTION

Accordingly, it is an object of the present invention to provide a means of achieving substantially uniform flow conditions into impellers of turbomachinery such as pumps, compressors, and turbines.

It is a further object of the present invention to provide circumferentially-varying energization of the flow approaching turbomachinery impellers.

It is still a further object of the present invention to provide the capability of matching a known nonuniform inlet flow profile to a fixed geometry rotating impeller in such a manner as to minimize circumferentially variations of impeller vane incident flow velocities and impeller vane incidence angles, and therefore, minimize periodic cavitation, stall, and impeller vane loading.

Other objects and advantages of the present invention will become apparent to those skilled in the art upon a reading of the following detailed description taken in conjunction with the drawings and the claims supported thereby.

In accordance with the present invention, these objects are met by providing a means for using jet-sheets as rotating blade surfaces to add energy to the flow upstream of the impeller of a turbomachine (i.e., impeller vane approach flow) in a circumferentially-varying manner tailored to the nonuniform energy profiles of the inlet flow. Resulting energy profiles of flow into the impeller (i.e., impeller vane incident flow) are efficiently matched to the fixed geometry of the impeller vanes. By providing nonuniform energization of impeller vane approach flow, relative velocities of the impeller vane incident flow are reduced, impeller vane angles of attack are reduced (i.e., the differences between the angle of individual impeller vanes and the angle of the impeller vane incident flow relative to the individual impeller vanes are reduced), and impeller vane incident flow energy profiles are smoothed. Thus, the present invention results in minimizing or avoiding periodic variations of impeller vane incidence angles and impeller vane loading during each impeller revolution.

In one embodiment of the present invention, a nonintrusive flow energizing system for providing circumferentially-varying energization of impeller vane incident flow is provided. The turbomachine is of the type including a housing having an upstream inlet and a downstream outlet, and an impeller mounted for rotation within the housing and having a plurality of impeller vanes projecting therefrom for accelerating flow from the inlet toward the outlet. The flow energizing system of the present invention includes means for forming a plurality of rotating jet-sheet blades upstream of the impeller, and means for circumferentially varying individual blade geometries of the plurality of rotating jet-sheet blades.

In a preferred embodiment, the means for forming a plurality of rotating jet-sheet blades includes an impeller shroud having an upstream-projecting axial extension, and a plurality of generally axially-extending slots distributed circumferentially around and passing through the periphery of the axial extension. The shroud is disposed coaxially with the impeller and is mounted for rotation therewith. The shroud encloses a flow chamber for channeling flow from the inlet to the outlet. The axial extension has an annular cross-section with a central aperture for allowing flow to pass from the inlet to the flow chamber. A recirculation chamber surrounds the shroud between the shroud and the housing. A recirculation flow inlet is formed by a gap between the housing and downstream ends of the shroud and impeller for allowing backflow to pressurize the recirculation chamber. The plurality of jet-sheet slots are shaped and configured on the shroud's axial extension to create a corresponding number of jet-sheet blades in the flow chamber upon recirculated flow from the recirculation chamber passing through the jet-sheet slots.

The means for circumferentially varying blade geometries of the plurality of rotating jet-sheet blades includes an axially-extending stationary liner disposed concentric with and radially inward of the axial extension. The liner is shaped and configured for selectively covering portions of the jet-sheet slots. The liner includes an upstream end coupled to the housing upstream of the axial extension and a downstream end projecting toward the impeller in a circumferentially-varying manner. As the shroud rotates, axially-varying portions of the jet-sheet slots are covered by the liner, such that, flow is prevented from passing through axially-varying portions of the of the jet-sheet slots.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding elements throughout and wherein.

DETAILED DESCRIPTION OF THE PREFERRED EMBODIMENT

Figure 1:
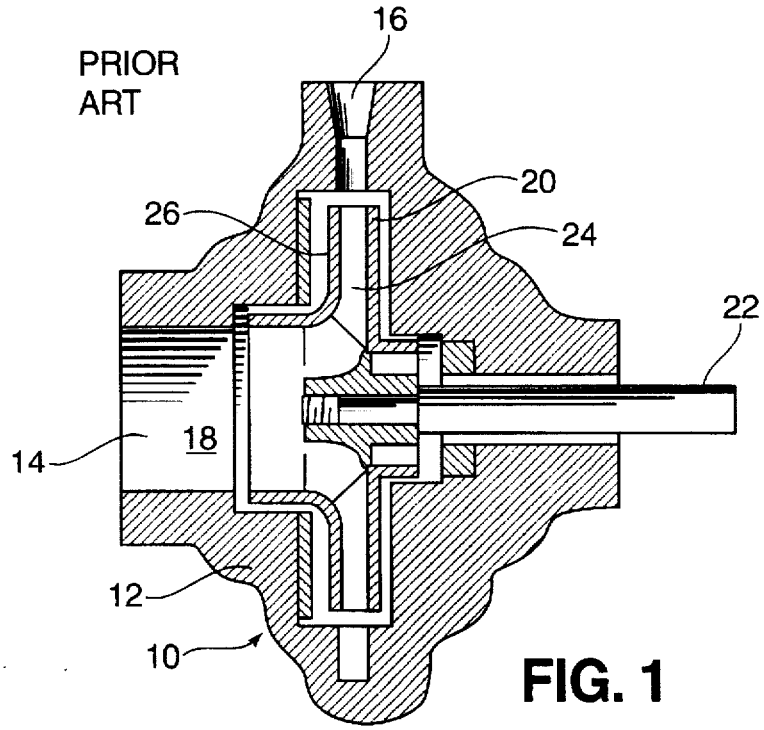
FIG. 1 is a sectional view of a prior art shrouded centrifugal pump.

Referring now to the drawings, FIG. 1 shows a typical prior art centrifugal pump 10 not incorporating the present invention. Centrifugal pump 10 includes pump housing 12 having upstream axial inlet 14, downstream radial outlet 16, and flow chamber 18 for channeling flow from inlet 12 to outlet 16. Impeller 20, mounted by conventional means, to rotating drive shaft 22, has a plurality of impeller vanes 24 projecting therefrom for accelerating a flow from inlet 34 toward outlet 16. Impeller shroud 26 is positioned coaxial with impeller 20 and is mounted for rotation therewith.

Figure 2:
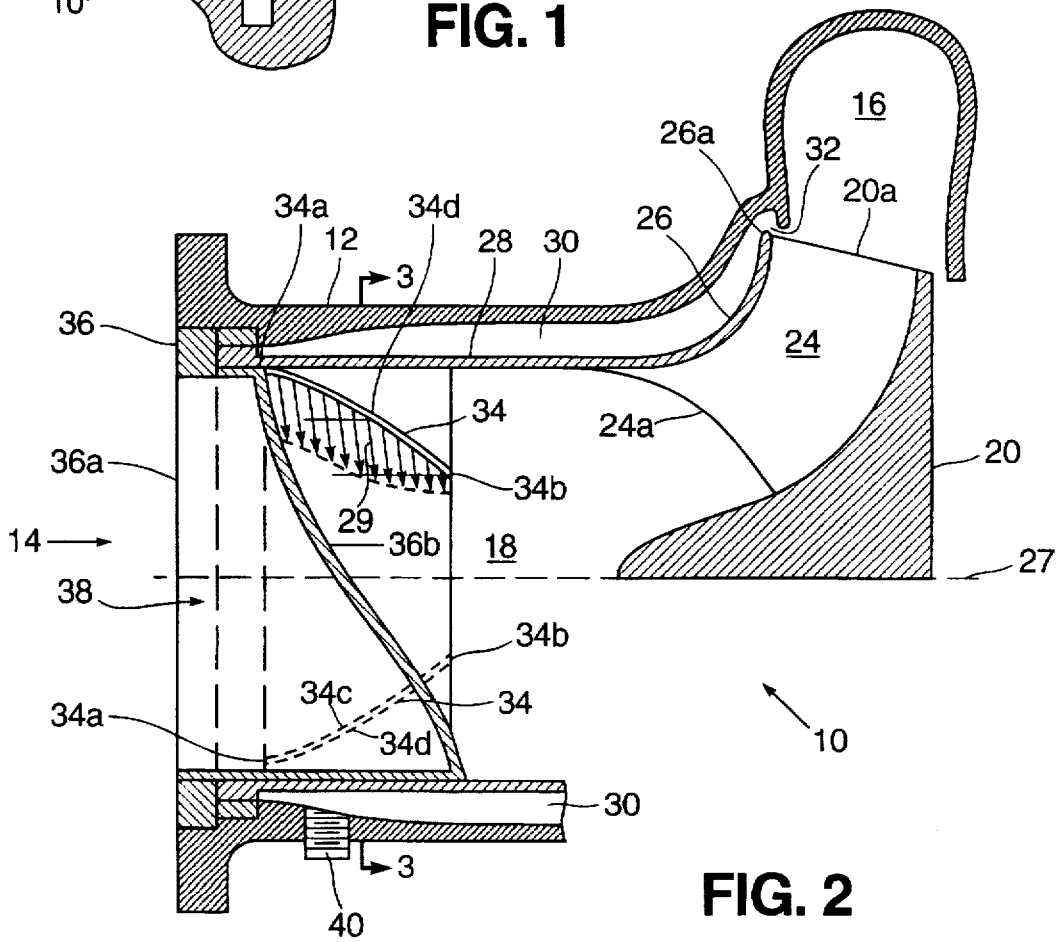
FIG. 2 is a sectional view of a turbomachine incorporating the present invention.

Referring now to FIG. 2, a centrifugal pump 10 incorporating the present invention is shown. Although the present invention is described and shown herein with reference to centrifugal pump 10, the present invention is equally applicable to other types of turbomachinery, such as, compressors, turbines, and pumps other than centrifugal pumps. The present invention comprises a nonintrusive, self sufficient, flow energizing system for providing selective (e.g., circumferentially-varying) energization of flow into impeller 20 of turbomachine 10. Turbomachine 10 includes housing 12 having upstream inlet 14, downstream outlet 16, and flow chamber 18 therebetween, and impeller 20 mounted for rotation within flow chamber 18. Impeller 20 has a plurality of impeller vanes 24 projecting therefrom for accelerating flow from inlet 14 toward outlet 16.

The following terms are defined for use herein in connection with the present invention. "Impeller vane approach flow" refers to flow, within flow chamber 18, upstream of leading edges **24*a* of impeller vanes 24. "Impeller vane incident flow" refers to flow entering the plane defined by leading edges 24*a* of impeller vanes 24, i.e., the local flow experienced by impeller vanes 24. "Impeller vane incidence angle" refers to the flow angle of the impeller vane incident flow relative to the impeller vane angle at leading edge 24*a*. Therefore, the impeller vane incidence angle at leading edge 24*a* of an individual impeller vane 24** defines the angle of attack of the individual impeller vane.

The flow energizing system of the present invention includes means for forming a plurality of rotating jet-sheet blades 29 upstream of impeller 20, and means for circumferentially varying the blade geometries of rotating jet-sheet blades 29. The formation of jet-sheet blades 29 utilizes the Foa energy transfer concept involving the direct transfer of energy from one fluid to another by means of a moving pressure field (cryptosteady pressure exchange). The formation of jet-sheets and the use of jet-sheets as rotating blades is well known in the art. For example, see: Foa, J. V. and C. A. Garris, "Cryptosteady Modes of Direct Fluid-Fluid Energy Exchange," in: *Machinery of Direct Fluid-Fluid Energy Exchange*, J. F. Sladky (Editor), American Society of Mechanical Engineers Book AD-7, (New York 1984) pp. 1–13. However, although jet-sheets have been employed as substitutes for propeller blades and impeller vanes, jet-sheet blades have not been used to pre-energize flow approaching impellers of turbomachinery. Essentially, the present invention employs jet-sheet blades to distribute energy circumferentially in order to turn the impeller vane approach flow such that impeller vane incident flow substantially aligns with individual impeller vanes 24 (i.e., the impeller vane incidence angle at each impeller vane 24 is reduced or minimized).

Figure 3:
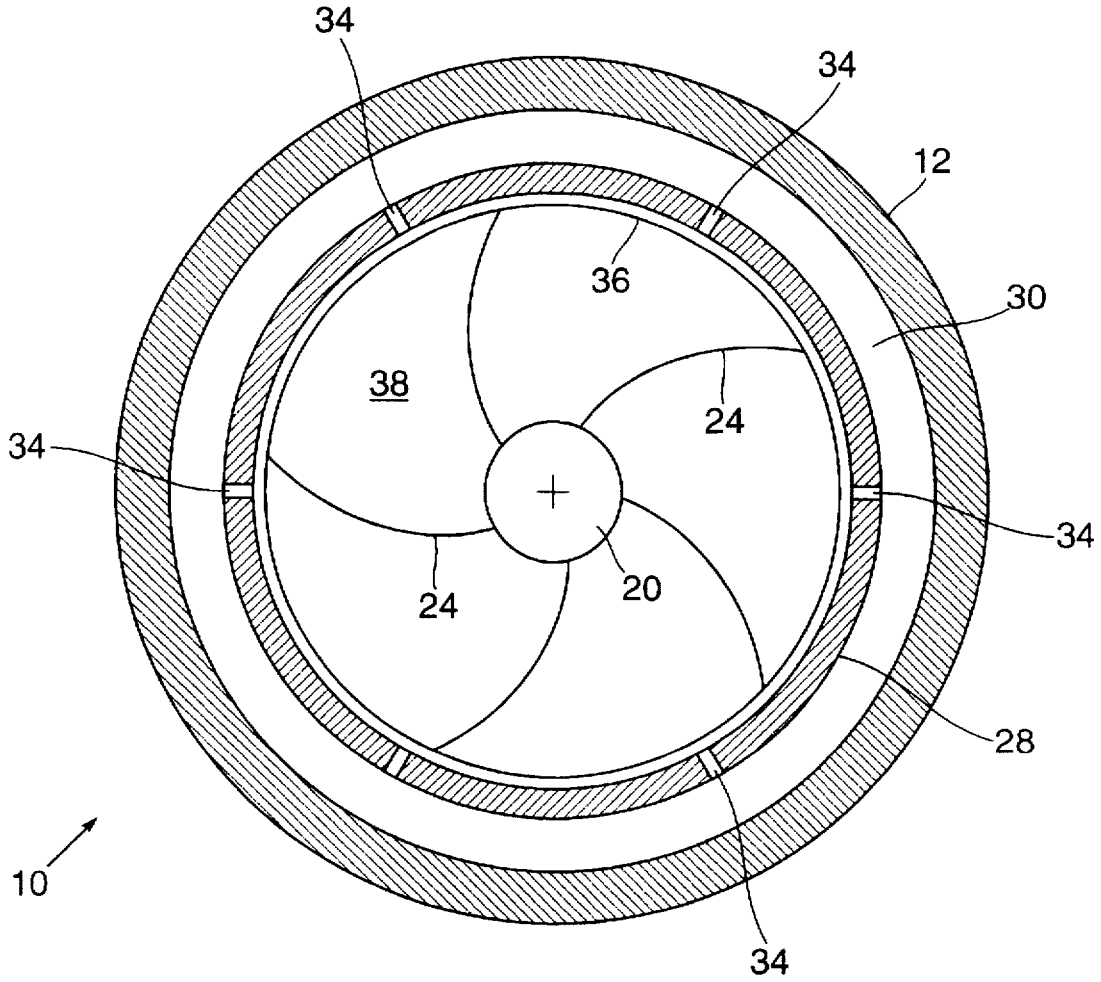
FIG. 3 is a view taken along line 3—3 of FIG. 2.

As shown in FIGS. 2 and 3, the means for forming a plurality of rotating jet-sheet blades includes: impeller shroud 26 having upstream-projecting axial extension 28 attached coaxially with and projecting upstream of shroud 26 towards inlet 14; recirculation chamber 30 surrounding shroud and axial extension, 26 and 28, between shroud and axial extension, 26 and 28, and housing 12; recirculation flow inlet 32 formed by a gap between housing 12 and downstream ends, **20*a* and 26*a*, respectively, of impeller 20 and shroud 26, for allowing backflow to pressurize recirculation chamber 30; and a plurality of generally axially-extending jet-sheet slots 34 distributed circumferentially around a periphery of axial extension 28** and passing therethrough.

Figure 4:
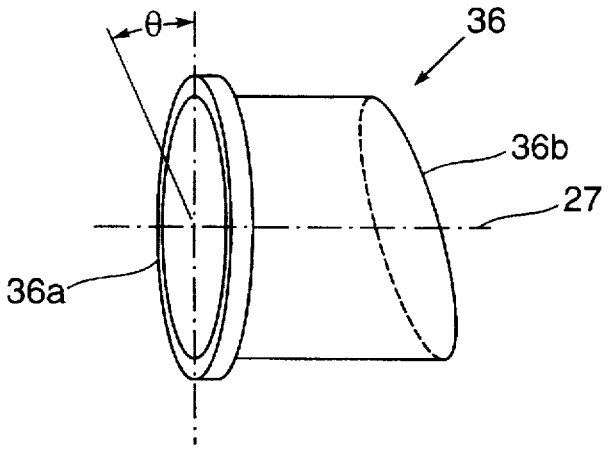
FIG. 4 shows one possible embodiment of the axially-shaped liner of the present invention.

As shown in FIG. 2 through 4, the means for circumferentially varying the blade geometries of the plurality of rotating jet-sheet blades 29 includes axially-extending stationary liner 36. Liner 36 is disposed concentric with and radially inward of axial extension 28. Liner 36 is shaped and configured for selectively covering portions of slots 34.

An existing turbomachine 10 having a shrouded impeller may be adapted for use with the present invention by extending flow chamber 18 axially between shroud 26 and inlet 14 and appending slotted axial extension 28 to shroud 26 within the axially-extended flow chamber 18. Alternatively, a shrouded turbomachine may be designed initially, in accordance with the present invention, to include shroud 26 and slotted axial extension 28. In either case, shroud and axial extension, 26 and 28, enclose flow chamber 18 for channeling flow from the inlet 14 to the outlet 16. Axial extension 28 has an annular cross-section with a central aperture 38 for allowing flow to pass from the inlet 14 through flow chamber 18 towards outlet 16.

Jet-sheet slots 34 are shaped and configured to form a corresponding number of jet-sheet blades 29 in flow chamber 18 upon recirculated flow from recirculation chamber 30 passing through slots 34. Each slot 34 includes leading edge **34*a* and trailing edge 34*b* downstream of leading edge 34*a*. Jet-sheet slots 34 are substantially axially-aligned in axial extension 28, i.e., leading edges 34*a* are substantially axially-aligned and trailing edges 34*b*** are substantially axially-aligned.

As shown in FIG. 2, slots 34 are shaped and configured to direct flow generally radially inward such that resulting jet-sheet blades 29 energize the impeller vane approach flow. Each of plurality of slots 34 is aligned at a slot angle relative to axial centerline 27 and have a mean camber line that is curved circumferentially in the direction of rotation of impeller 20 from leading edge **34*a* to trailing edge 34*b* such that each slot 34 has a pressure face 34*c* facing into the direction of rotation and a suction face 34*d* facing opposite the direction of rotation. Generally, suction face 34*d* is convex. Depending on the thickness of slot 34, pressure face 34*c* may be concave, convex, or partially concave and partially convex. Preferably, a peripheral contour of each slot 34 forms a cambered airfoil section. Pressurized flow from recirculation chamber 30 is forced through slots 34 to form generally radially-projecting jet-sheet blades 29 having cross-sectional profiles that match the peripheral contour of slots 34**.

As shown in FIG. 3, slots 34 pass through axial extension 28 in a direction substantially normal to the peripheral surface of axial extension 28 and, thus, direct flow radially inward. However, slots 34 may be aligned to pass flow through axial extension 28 in a non-radial direction (e.g., canted into or away from the direction of rotation) in order to direct flow in a non-radial direction that adds or subtracts velocity relative to impeller rotation.

To properly turn the impeller blade approach flow so that the resulting impeller vane incident flow substantially aligns with vanes 24 at leading edges 24*a*, a predetermined amount of energy must be added to the flow. To generate the required energy profile, a predetermined total jet-sheet blade area is required. Thus, a trade-off must be made among the total number of jet-sheet blades 29 (and, thus, the total number of slots 34), the chord length of jet-sheet blades 29 (and, thus, the length of axial extension 28), and the added axial length of flow chamber 18 required to house axial extension 28. The more jet-sheet blades 29 employed the shorter each blade chord need be. For example, doubling the number of slots 34 approximately halves their chord and, thus, about halves the axial length of axial extension 28. Such a trade-off must include the ultimate size of turbomachine 10 and the space available for installing turbomachine 10. Such a trade-off is well within the skill of the person of ordinary skill in the art given the guidance provided herein.

Figure 5A:
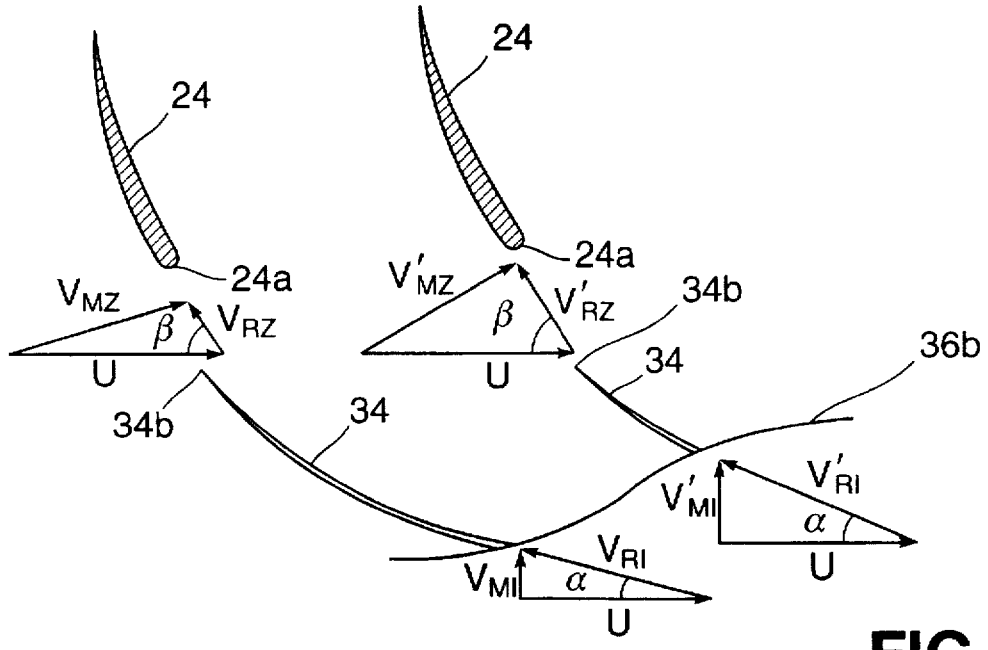
FIGS. 5A, 5B and 5C are vector diagrams resulting from the practice of the present invention.
Figure 5B:
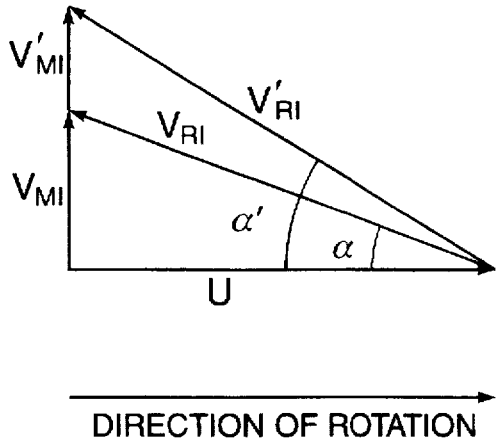
Figure 5C:
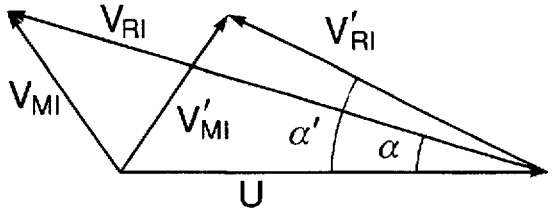

Referring to FIGS. 5A, 5B and 5C, $V_{MX}$ is the inlet flow velocity component wherein subscript 1 indicates the component upstream of slots 34 (i.e., velocity vector of the flow entering flow chamber 18 upstream of and, therefore, unaffected by jet-sheet blades 29), and subscript 2 indicates the component downstream of slots 34 (i.e., velocity vector of the flow in flow chamber 18 downstream of and, therefore, affected by jet-sheet blades 29), U is the rotational velocity component added by rotating jet-sheet blades 29 and impeller vanes 24, $V_{RX}$ is the relative velocity (i.e., the velocity vector resulting from the superposition of inlet flow component $V_{MX}$ and rotational component U), $\alpha$ is the relative flow angle upstream of jet-sheet blades 29, and $\beta$ is the angle of the impeller vane incident flow at leading edge 24*a*. Ideally, $\beta$ is equal to the impeller vane angle so that the impeller vane incidence angle is zero. Primed notation in FIGS. 5A, 5B and 5C denotes velocity vectors that vary from one circumferential location to another due to flowfield distortions.

The shape of liner 36 is determined, as more fully described below, based on the energy and velocity profiles of the inlet flow entering flow chamber 18 upstream of slots 34. The determination of energy and velocity profiles of the inlet flow (pipe flow) is well within the state of the art and will not be discussed herein. Once the velocity profile is known, the circumferential variation of the inlet flow velocity component $V_{M1}$ is determined. Circumferentially-varying inlet flow approaches the impeller plane at circumferentially-varying angles of incidence. Consequently, as impeller 20 rotates, individual impeller vanes 24 experience periodic variations in impeller vane incidence angles and vane loading. The present invention provides circumferentially-varying energization of the impeller vane approach flow in order to turn the approach flow such that impeller vane incident flow is substantially aligned with corresponding impeller vanes 24 at leading edges 24*a* at all points during impeller rotation (i.e., impeller vane incidence angles/angles of attack of impeller vanes 24 are reduced).

Liner 36 is shaped and configured for selectively covering portions of slots 34 whereby flow from recirculation chamber 30 is prevented from passing through the covered portions of slots 34. Preferably, axial extension 28 and liner 34 are concentric cylinders. However, they may also be curved or straight-walled tapered shapes such as fluted cylinders or truncated conical sections.

The axial length of stationary liner 36 varies around its circumference between fixed upstream end 36*a* and circumferentially-varying downstream end 36*b*. In a preferred embodiment, as shown in FIG. 2, upstream end 36*a* is coupled with housing 12 upstream of axial extension 28, and downstream end 36*b* projects toward impeller 20 in a circumferentially-varying manner. The minimum axial length of liner 36 (and, thus, maximum chord length of slots 34) occurs where downstream end 36*b* is approximately axially co-located with, or just upstream of, leading edges 34*a* of slots 34. The maximum axial length of liner 36 (and, thus, minimum chord length of slots 34) may vary, depending on the particular known flow profile experienced in a particular application, wherein the axial position of downstream end 36*b* of liner 36 varies circumferentially between leading and trailing edges, 34*a* and 34*b* of slots 34. FIG. 4 depicts the axial length of liner 36 varying between fixed upstream end 36*a* and circumferentially-varying downstream end 36*b* in a substantially linear fashion. However, the axial length of liner 36 may vary in any fashion based on the inlet flow profile of turbomachine 10, e.g., sinusoidal variation.

As impeller 20, shroud 26 and axial extension 28 rotate, axially-varying portions of slots 34 are covered by liner 36 preventing flow from passing through axially-varying portions of each of slots 34. In this way, liner 36 provides the means for circumferentially varying the blade geometries of jet-sheet blades 29 such that resulting jet-sheet blades 29 energize flow upstream of impeller 20 in a circumferentially-varying manner. As shown in FIG. 5A, liner 36 is shaped and configured to allow control of leading edge angles of jet-sheet blades 29 by modifying the axial location of the jet-sheet blade leading edges. As impeller 20, shroud 26 and axial extension 28 rotate, more or less of the upstream end of each individual slot 34 is shrouded by liner 36 such that the axial position of the resulting jet-sheet blade leading edge changes. Consequently, based on the curvature of slots 34, each jet-sheet blade substantially aligns with the relative flow angle at that jet-sheet blade leading edge.

Referring to FIG. 5A, flow upstream of slots 34 having a smaller relative flow angle a must be turned more by jet-sheet blades 29 in order to align with impeller vanes 24. Thus, liner 36 is shaped and configured relative to circumferentially-varying inlet flow entering flow chamber 18 such that circumferentially located inlet flow having a smaller relative flow angle receives more energy than inlet flow having a larger relative flow angle. For example, for axially directed inlet flow (FIG. 5B), inlet flow that has a lower inlet velocity receives more energy than inlet flow having a velocity that is relatively higher. Additionally, for inlet flow having equal axial velocity components (FIG. 5C), flow that includes a velocity component directed counter to a direction of impeller rotation receives more energy compared to flow that has a velocity component directed with the direction of impeller rotation.

When the axial length of the liner 36 is small, less of jet-sheet slot 34 is covered and therefore a larger jet-sheet blade results and more energy is added to the flow. When the axial length of the liner 36 is large, more of jet-sheet slot 34 is covered and therefore a smaller jet-sheet blade results and less energy is added to the flow. Therefore, for axially directed inlet flow (FIG. 5B), the axial length of liner 36 is less at points circumferentially co-located with flow that has a lower inlet velocity compared with flow having a higher inlet velocity. Additionally, for inlet flow having equal axial velocity components of the inlet flow (FIG. 5C), the axial length of liner 36 is less at points circumferentially co-located with flow that has an inlet velocity component directed counter to the direction of impeller rotation compared to flow that has an inlet velocity component directed with the direction of impeller rotation.

Such a configuration has two effects: first, due to the curvature of jet-sheet slots 34 and resulting jet-sheet blades 29, as more of slot 34 is covered, the resulting leading edge has a larger angle to match the larger relative flow angle into the jet-sheet blade leading edge; second, because flow having a larger relative flow angle needs to be turned less to align with impeller vane 24, as more of slot 34 is covered the smaller resulting jet-sheet blade 29 adds less energy to the flow.

The circumferentially-varying jet-sheet blade geometries function to modify the flow downstream of jet-sheet blades 29 relative to flow upstream of jet-sheet blades 29 such that: (a) impeller vane incidence angles are more uniform circumferentially and are angles of impeller vane incident flow are maintained at a desired value matched to impeller vane geometries, thus, minimizing both the impeller vane incidence angle/angle of attack of impeller vanes 24 and the periodic variations thereof; (b) impeller vane incident flow energy profiles are more uniform circumferentially than the flow profiles upstream of jet-sheet blades 29, thus, minimizing periodic variations of impeller vane loading; (c) relative velocities of the impeller vane incident flow are reduced by the preswirl vectors added by jet-sheet blades 29, thus, allowing higher impeller rotational speeds; and (d) through-flow components of velocity ($V_{MX}$) are more uniform downstream of jet-sheet blades 29 than upstream.

The highest relative velocities are experienced at the outer diameter of flow chamber 18. Thus, flow conditions are most critical, in terms of energy and cavitation, at the outer diameter of flow chamber 18. The present invention provides maximum energy and jet-sheet blade geometry control at about the outer ¼ of the diameter of flow chamber 18, thus, effecting flow more at the outer diameter. The concentric arrangement of recirculation chamber 30, axial extension 28, and liner 36, as shown in FIG. 3, is convenient and easily adapted to present turbomachine designs. Moreover, due to centrifugal force of the rotating fluid, the radial inflow is not prone to clogging slots 34 with solid debris or particles. A blowdown fitting 40 may be provided in housing 12 to remove debris.

Further flexibility may be gained by providing a means for axially adjusting the location of liner 36 relative to axial extension 28 and/or by providing a means for rotationally adjusting, about a rotation axis of impeller 20, the position of liner 36 relative to axial extension 28. One skilled in the art could determine appropriate means for providing such axial and rotational position adjustments, and thus, they will not be discussed in detail herein.

The advantages of the present invention are numerous. The present invention is a nonintrusive, self-sufficient means of adding a desired energy profile to impeller blade approach flow. That is, the present invention does not require an external source of pre-energizing flow as in prior art flow injection methods, and further, does not require upstream guide vanes that rob the flow of energy.

The rotating jet-sheet blades formed by the rotating jet-sheet slots of the present invention are altered in geometry by the axially shaped, stationary liner of the present invention. The circumferentially-varying jet-sheet blade geometries provide the unique capability of matching a stationary nonuniform flow profile to a fixed-geometry rotating impeller. Thus, the present invention provides circumferentially-varying energization of impeller vane approach flows in such a way as to minimize or avoid periodic variations of impeller vane incidence angles and impeller vane loading during each impeller revolution. Maintaining more uniform impeller vane incident flow conditions allows superior cavitation performance, reduced vibration, and avoidance of stall related performance penalties and flow instabilities. Benefits include reduced wear of impeller vanes and other internal components, longer part life, enhanced performance, and lower vibration. Moreover, due to the reduction in impeller vane incident flow relative velocities, the present invention allows for higher rotational speeds at both design and off-design conditions. Higher rotational speeds allow reduced impeller and housing diameters, which in turn allow reduced machine size and weight. Furthermore, weight of drive motors, shafts, gearboxes, and other components are reduced.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. It is therefore to be understood, the forms of the present invention herein described are not intended to be limiting but are merely preferred or exemplary embodiments thereof and, within the scope of the appended claims, the invention may be practiced other than as specifically described.

What is claimed is:

1. A nonintrusive flow energizing system for providing circumferentially-varying energization of a flow into an impeller of a turbomachine, the turbomachine including a housing having an upstream inlet and a downstream outlet, the impeller mounted for roatation within the housing and having a plurality of impeller vanes projecting therefrom for accelerating the flow from the inlet toward the outlet, said flow energizing system comprising:

means for forming a plurality of rotating jet-sheet blades upstream of the impeller; and means for circumferentially varying blade geometries of said plurality of rotating jet-sheet blades;

wherein said means for forming a plurality of rotating jet-sheet blades comprises:

an impeller shroud coaxial with the impeller and mounted for rotation therewith, said impeller shroud having an upstream-projecting axial extension, said shroud defining a flow chamber within said shroud and between said shroud and the impeller, said axial extension having an annular cross-section with a central aperture for allowing flow to pass from the inlet to said flow chamber; and a plurality of generally axially-extending slots distributed circumferentially around a periphery of said axial extension and passing therethrough, said plurality of slots shaped and configured to create a corresponding number of jet-sheet blades in said flow chamber upon flow passing through said slots.

2. A system as in claim 1 wherein said means for forming a plurality of rotating jet-sheet blades further comprises:

a recirculation chamber surrounding said shroud between said shroud and the housing; and a recirculation flow inlet between the housing and downstream ends of said shroud and impeller, wherein recirculated flow from said recirculation chamber passes through said plurality of slots to form said jet-sheet blades.

3. A system as in claim 1 wherein said means for circumferentially varying blade geometries of said plurality of rotating jet-sheet blades comprises an axially-extending stationary liner, said liner disposed concentric with and radially inward of said axial extension, said liner shaped and configured for selectively covering portions of said slots.

4. A system as in claim 3 wherein said liner includes upstream and downstream ends, said upstream end being coupled to the housing upstream of said axial extension, said downstream end projecting toward the impeller in a circumferentially-varying manner such that, as said shroud rotates, axially-varying portions of said slots are covered by said liner.

5. A system as in claim 1 wherein:

a peripheral contour of each of said plurality of slots forms a cambered airfoil section; and said means for circumferentially varying blade geometries comprises an axially-extending stationary liner, said liner disposed concentric with and radially inward of said axial extension, said liner having an axial length circumferentially-varying between a fixed upstream end and a circumferentially-varying downstream end, said liner functioning, as said shroud rotates, to prevent flow from passing through axially-varying portions of each of said slots.

6. A system as in claim 5 wherein said axial extension and said liner are concentric cylindrically shaped units.

7. A system as in claim 5 further comprising:

means for axially adjusting a location of said liner relative to said axial extension.

8. A system as in claim 5 further comprising:

means for rotationally adjusting, about a rotation axis of the impeller, a position of said liner relative to said axial extension.

9. In combination with a turbomachine including a housing having an inlet, an outlet and a flow chamber therebetween, an impeller mounted for rotation within the flow chamber and having a plurality of impeller vanes projecting therefrom for accelerating a flow from the inlet toward the outlet, and an impeller shroud coaxial with the impeller and mounted for rotation therewith, an improvement for selectively energizing flow upstream of the impeller, said improvement comprising:

an axial extension attached coaxially with and projecting upstream of the impeller shroud;

a recirculation chamber surrounding said shroud and axial extension between said shroud and axial extension and the housing;

a plurality of generally axially-extending jet-sheet slots distributed circumferentially around a periphery of said axial extension, said plurality of slots shaped and configured to form within said flow chamber a corresponding number of jet-sheet blades upon flow from said recirculation chamber passing through said slots; and an axially-extending stationary liner, said liner disposed concentric with and radially inward of said axial extension, said liner shaped and configured for selectively covering portions of said slots whereby flow from said recirculation chamber is prevented from passing through said portions of said slots.

10. The combination of claim 9 wherein said liner includes upstream and downstream ends defining a circumferentially-varying axial length of said liner, said upstream end being coupled to the housing upstream of said axial extension, said downstream end projecting toward the impeller in a circumferentially-varying manner such that, as said shroud rotates, axially-varying portions of said slots are covered by said liner wherein said liner provides a means for circumferentially varying blade geometries of said jet-sheet blades.

11. The combination of claim 10 wherein said plurality of slots are substantially identically shaped and axially-aligned on said axial extension, each said slot including a leading edge and a trailing edge downstream of said leading edge, wherein an axial position of said downstream end of said liner varies circumferentially between said leading and trailing edges.

12. The combination of claim 9 wherein:

said plurality of slots are shaped and configured to direct flow substantially radially inward such that resulting jet-sheet blades add energy to the flow into the impeller, said resulting jet-sheet blades each having leading and trailing edges; and said liner is shaped and configured to modify the axial location of each said jet-sheet blade leading edge such that each said jet-sheet blade leading edge substantially aligns with an angle of incidence of the flow into said jet-sheet blade leading edge.

13. The combination of claim 9 wherein:

each of said plurality of slots has a mean camber line that is curved circumferentially in the direction of rotation of the impeller from an upstream leading edge to a downstream trailing edge such that each said slot has a pressure face facing into the direction of rotation and a convex suction face facing opposite the direction of rotation;

said liner has an axial length circumferentially-varying between a fixed upstream end and a circumferentially-varying downstream end, said liner functioning, as said shroud rotates, to prevented flow from passing through axially-varying portions of each of said slots such that resulting circumferentially-varying jet-sheet blades function to energize flow upstream of the impeller in a circumferentially-varying manner wherein a leading edge of each of said plurality of impeller vanes is substantially aligned with an angle of incidence of the flow into said impeller vane leading edge.

14. The combination of claim 13 wherein a peripheral contour of each of said plurality of slots forms a cambered airfoil section.

15. The combination of claim 9 wherein said axial extension has an annular cross-section with a central aperture for allowing flow to pass from the inlet through the flow chamber, and said recirculation chamber includes a recirculation flow inlet between the housing and downstream ends of the shroud and impeller.

16. The combination of claim 9 wherein said axial extension and said liner are concentric cylinders.

17. The combination of claim 16 further comprising:

means for axially adjusting a location of said liner relative to said axial extension.

18. The combination of claim 16 further comprising:

means for rotationally adjusting, about a rotation axis of the impeller, a position of said liner relative to said axial extension.

* * * * *